US005632646A

United States Patent [19]

Ii et al.

[11] Patent Number: 5,632,646

[45] Date of Patent: May 27, 1997

[54] ELECTRIC CONNECTOR FOR FLEXIBLE FLAT CABLES

[75] Inventors: Hidehiro Ii, Koube; Shinichi Aihara, Ebina, both of Japan

[73] Assignee: Molex Incorporated, Lisle, Ill.

[21] Appl. No.: 557,878

[22] Filed: Nov. 14, 1995

[30] Foreign Application Priority Data

Dec. 16, 1994 [JP] Japan ..... 6-016614 U

[51] Int. Cl.[6] ..... H01R 9/07

[52] U.S. Cl. ..... 439/495; 439/77

[58] Field of Search ..... 439/495, 496, 439/492, 493, 494, 497, 499, 67, 77, 260

[56] References Cited

U.S. PATENT DOCUMENTS

| | | | |
|---|---|---|---|
| 4,519,133 | 5/1985 | Pansanel | 29/863 |
| 4,695,108 | 9/1987 | Ichitsubo | 439/59 |
| 4,734,053 | 3/1988 | Imai | 439/329 |
| 4,900,268 | 2/1990 | Kunishi | 439/493 |
| 4,944,690 | 7/1990 | Imai | 439/492 |
| 4,969,840 | 11/1990 | Ii et al. | 439/495 |
| 5,106,311 | 4/1992 | Yodogawa et al. | 439/77 |
| 5,194,017 | 3/1993 | Consoli | 439/492 |
| 5,240,430 | 8/1993 | Soes | 439/260 |
| 5,308,262 | 5/1994 | Chishima | 439/495 |

FOREIGN PATENT DOCUMENTS

| | | | |
|---|---|---|---|
| 0087710B1 | 10/1986 | European Pat. Off. | H01R 23/68 |
| 0312386 | 4/1989 | European Pat. Off. | 439/499 |
| 2-86080 | 3/1990 | Japan | H01R 23/00 |
| 3-163771 | 7/1991 | Japan | H01R 23/00 |
| 4-61883 | 5/1992 | Japan | H01R 23/68 |
| 7/22129 | 1/1995 | Japan | H01R 23/68 |
| 2244181 | 11/1991 | United Kingdom | 439/499 |
| 2272583A | 5/1994 | United Kingdom | H01R 4/28 |

OTHER PUBLICATIONS

Molex Japan Full Line Catalog, May 1993, p. 245, Part No. 52437–27 (Molex).

*Primary Examiner*—David L. Pirlot
*Assistant Examiner*—Tho Dac Ta
*Attorney, Agent, or Firm*—Stephen Z. Weiss

[57] ABSTRACT

An improved electric connector which permits insertion of a flexible flat cable in its insertion space without causing oblique insertion or misalignment between the exposed conductors of the cable and the terminals of the connector housing. The central feature of the electric connector resides in the lateral distance between the opposed side walls of the connector housing to be tapered with a dimension smaller than the width of the flexible flat cable.

5 Claims, 3 Drawing Sheets

ELECTRIC CONNECTOR FOR FLEXIBLE FLAT CABLES

FIELD OF THE INVENTION

The present invention relates to an improvement in or relating to electric connectors for connecting centered flexible flat cables (FFCs) or centered flexible printed circuits (FPCs) to other printed circuits and electrical devices.

DESCRIPTION OF RELATED ART

As is well know, flexible flat cables (FFCs) and flexible printed circuits (FPCs) have been widely used in connecting different electric devices such as printed circuits to each other. The connector housing is composed of a ceiling wall, an opposed floor wall, and opposed side walls integrally connected to the opposed ceiling and floor walls to define a space for accommodating the FPC or FFC, and a plurality of terminals arranged at the same pitch as the conductors of the FPC or FFC are fixed to the connector housing.

The lateral distance between the opposite parallel side walls is equal to or somewhat longer than the width of the flexible flat cable, thereby facilitating insertion of the flexible flat cable.

The freedom of lateral movement of the flexible flat cable within the cable insertion space may allow the flexible flat cable to move laterally or obliquely. The length of the movement may be the same as the length defining the terminal pitch, thus causing misalignment of the conductors of the cable relative to the terminals of the connector housing. An incomplete connection between the conductors of the cable and the terminals of the electric connector may occur causing short circuits across selected terminals.

SUMMARY OF THE INVENTION

One object of the present invention is to provide an improved electric connector for flexible flat cables and printed flexible circuits where the connector is guaranteed to be free of such a misalignment between the conductors of the cable and the terminals of the connector housing which could cause incomplete connection therebetween when the cable is inserted in the connector housing.

To attain this and other objects of the present invention an electric connector is provided for connecting a flexible flat cable having a given width to an electrical device. An insertion space in a dielectric housing is adapted to receive an end of the flexible flat cable through an insertion space opening. The insertion space is defined by a floor wall, an opposed ceiling wall and two opposed symmetrical side walls extending between the floor and ceiling walls. Electrical terminals are secured in the floor wall with each terminal having a contact portion extending from the floor wall into the insertion space for electrical connection to a respective exposed conductor on the flexible flat cable when the end of the flexible flat cable is positioned in the insertion space.

The insertion space opening is defined by edges of the floor and ceiling walls and the opposed symmetrical side walls. The opposed side walls form a dimension therebetween, parallel to the floor wall, which increases as the side walls diverge from the floor wall to the ceiling wall. The longest dimension between the side walls being less than or equal to the width of the flat flexible cable so the that each longitudinal edge of the end of the cable contacts a respective side wall. This will cause the end of the flexible flat cable to form a curve about the longitudinal axis of the cable with the apex of the curve being located closer to the floor wall rather than to the ceiling wall. The ends of cable wall contact the opposed side walls causing the exposed conductors of the end of the cable to be in alignment with the contact portions of the terminals. An actuator is mounted to the housing to move from an open position, enabling the end of the cable to be inserted into the insertion space, to a closed position, forcing the end of the cable toward the first elongated wall creating an aligned engagement between the exposed conductors of the cable and the contact portions of the terminals.

BRIEF DESCRIPTION OF THE DRAWINGS

Other objects and advantages of the present invention will be understood from the description of the electric connector according to the preferred embodiment of the present invention, which is shown in accompanying drawings, in which.

DESCRIPTION OF THE PREFERRED EMBODIMENT

Figure 1:
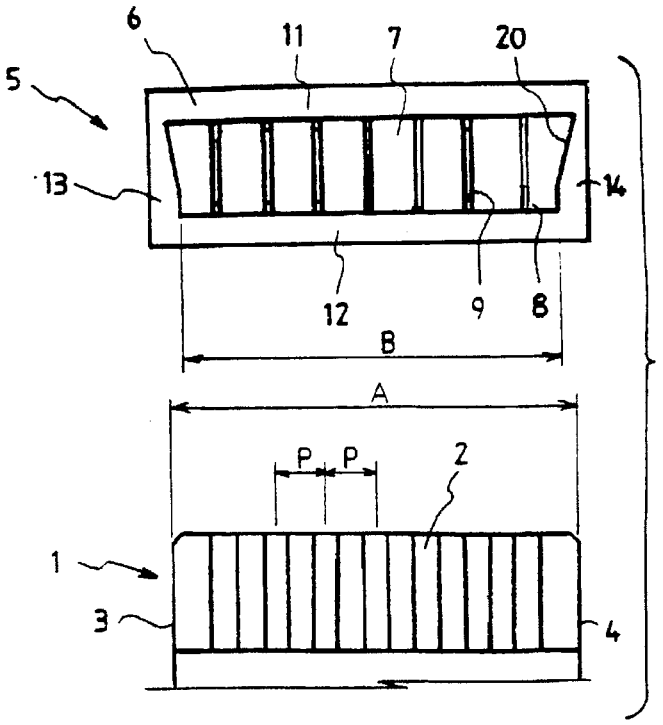
FIG. 1 is a front view of an electric connector according to one embodiment of the present invention and a plan view of the stripped end of a flexible flat cable.

As shown in FIG. 1, an electric connector 5 for flexible flat cables comprises a housing 6 and a plurality of terminals 8 fixed to the housing 6. The housing 6 comprises a ceiling wall 11, a floor wall 12 and opposed side walls 13 and 14 integrally connected to the ceiling wall 11 and the floor wall 12. A flexible flat cable insertion space 7 is defined by the ceiling wall 11, the floor wall 12, and the opposed side walls 13 and 14. The terminals 8 in the flexible flat cable insertion space 7 are arranged at the same pitch P as the conductors 2 of a flexible flat cable 1.

A flexible flat cable (FFC) or flexible printed circuit (FPC) is stripped of its insulation so that the conductors 2 of the cable 1 are exposed at the end of the cable 1. The exposed conductors 2 of the cable 1 are made to contact the terminals 8 of the connector housing 6.

The lateral distance between the opposed side walls 13 and 14 of the connector housing 6 increases from B to B' as the side walls 13 and 14 extend from the floor wall 12 to the ceiling wall 11. The longest dimension B' at the ceiling wall 11 is equal to or shorter than the width A of the flexible flat cable 1. Each of the opposed side walls 13 and 14 forms an equal and opposite angle with the ceiling wall.

The stripped end of the flexible flat cable 1 is inserted into the flexible flat cable insertion space 7. As shown in FIG. 3B the longest lateral size B' of the cable insertion space 7 is shorter than the width A of the cable 1. The end of the cable inserted into the cable insertion space will be yieldingly bent about its longitudinal axis in the form of circular arc. The apex of the arc is curved toward the floor wall 12. As a consequence the flexible flat cable 1 can be put in correct position relative to the terminals 8 of the connector housing 5 because no lateral movement of the cable 1 is permitted in the equilibrium condition attained by the resiliency of the cable 1 with its opposite longitudinal sides 3 and 4 abutting on the opposite side walls 13 and 14 of the connector housing 6 forming curved end portions C. Stated otherwise, there can be no misalignment of the cable conductor 2 relative to the connector terminals 8, which misalignment would be caused by the lateral or angular movement of the cable conductors 2 if the lateral size of the cable insertion space 7 were somewhat longer than the width of the cable 1.

Figure 3A:
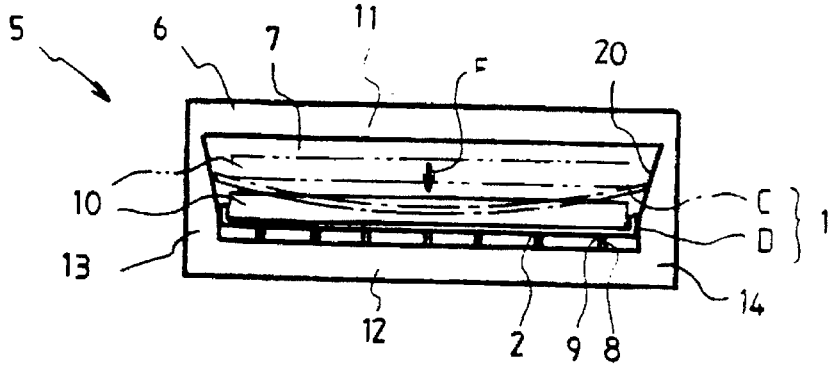
FIG. 3*a* is a view similar to FIG. 2, but showing the cable partially and fully fixed in the connector housing.
Figure 3B:
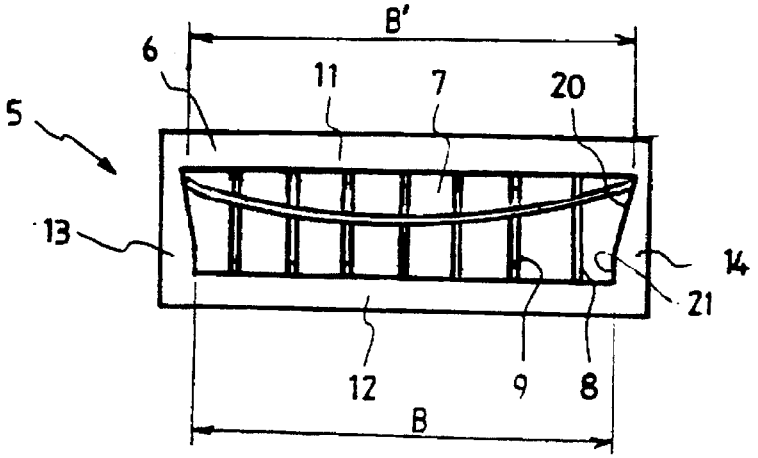
FIG. 3*b* is a front view of the electric connector showing the cable wider than the longest dimension of the cable opening.

Next, as shown in FIG. 3*a*, fastening means 10 is used to push the curved cable against the floor wall 12 of the connector housing as indicated by arrow F, thereby bending the opposite longitudinal sides 3 and 4 of the flexible flat cable 1 forming bent end portions D to take a "U"-shaped form in cross section, and forcing the conductors 2 of the flexible flat cable 1 into close contact with the terminals 8 of the connector 5.

The bending of the opposite longitudinal sides 3 and 4 of the flexible flat cable 1 along the opposite vertical side walls 13 and 14 of the connector housing permits automatic alignment of the cable 1 relative to the terminals 8 of the connector 5 with such accuracy that incomplete contact and short circuits are avoided.

Figure 6:
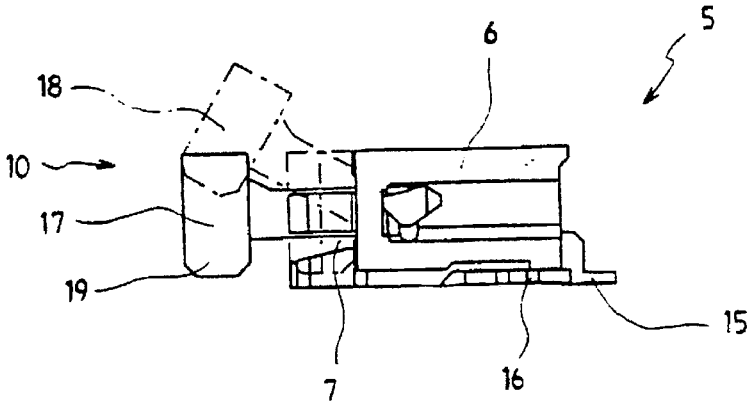
FIG. 6 is a side view of the actual electric connector.
Figure 7:
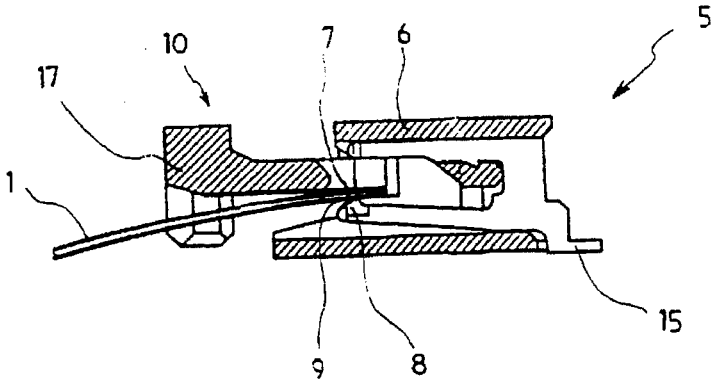
FIG. 7 is a cross section of the actual electric connector taken along the line J—J in FIG. 5, showing the cable fastened in the connector housing.
Figure 4:
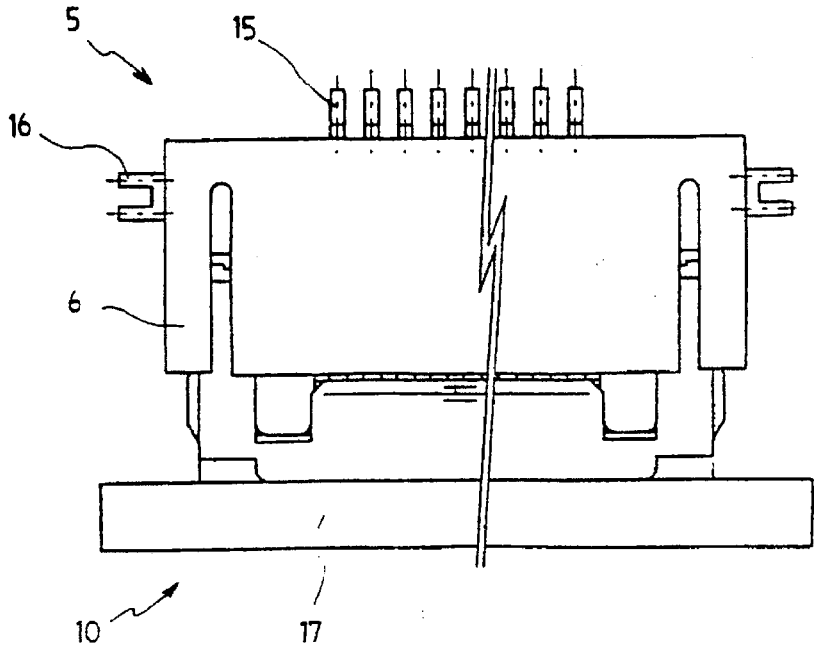
FIG. 4 is a plan view of one actual example of an electric connector according to one embodiment of the present invention.
Figure 5:
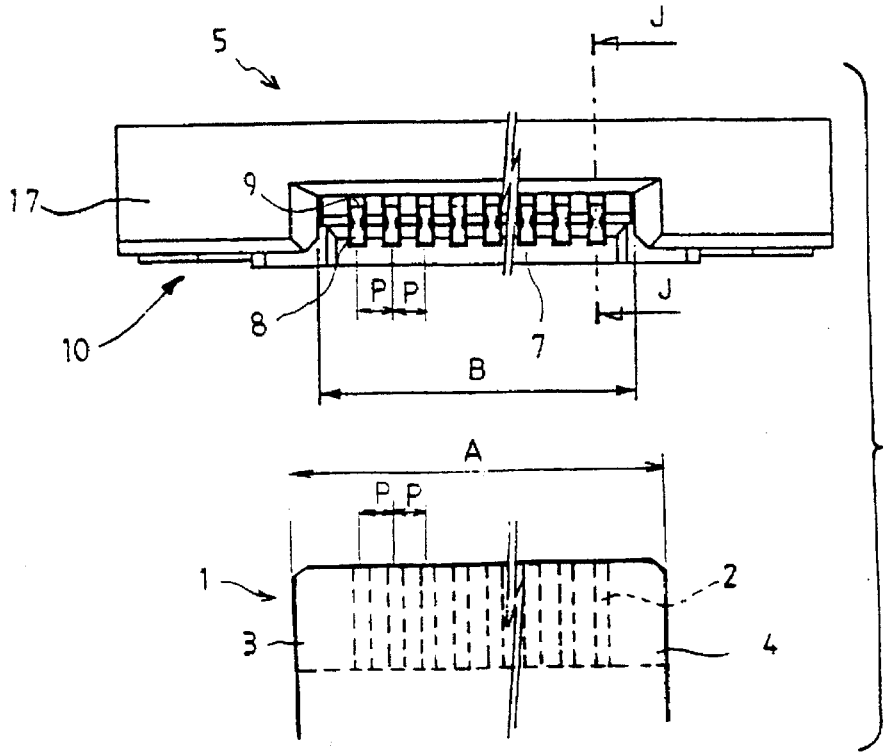
FIG. 5 is a front view of the actual electric connector and a plan view of the stripped end of the flexible flat cable.

FIGS. 4, 5 and 6 show such an electric connector for flexible flat cables in detail. As shown, it has solder pieces 16 extending from housing 6 for fastening the connector to a printed circuit board (not shown). Also, cable fastening means 10 appears as actuator 17.

The terminals 8 are arranged at same pitch as the pitch P at which the conductors 2 of the cable 1 are arranged. Each terminal 8 has a "U"-shaped cross section, and it has a solder tail portion 15 for soldering to a selected conductor on a printed circuit board.

Figure 2:
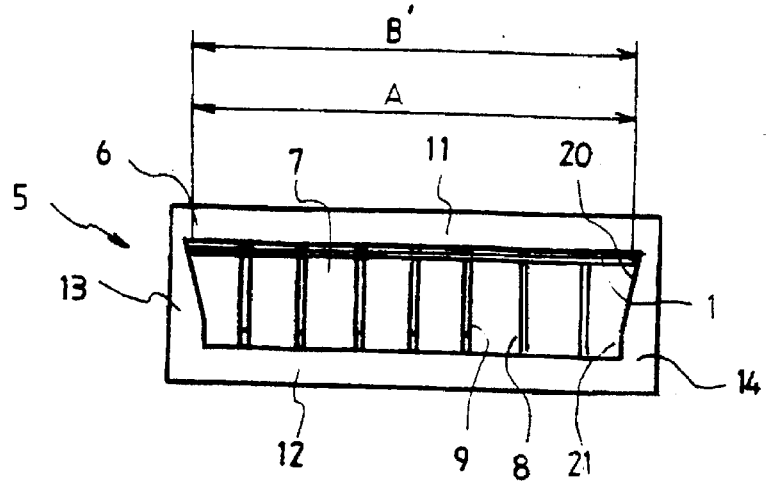
FIG. 2 is a front view of the electric connector, showing the cable inserted in the connector housing.

As shown in FIG. 3*b*, the longest lateral distance B' between the opposite side walls 13 and 14 of the connector housing is shorter than the width A of the flexible flat cable 1. This will cause the cable to form a curve. However, as shown in FIG. 2, the longest lateral distance B' may be equal to or slightly greater than the width A of the flexible flat cable 1. Either condition will work with this invention.

To insert the flexible flat cable 1 into the cable insertion space 7, the actuator 17 is raised up in an unlocking position 18 (broken lines in FIG. 6). The contact portions 9 of the terminals 8 extend up from the floor wall 12 of the connector housing. Since the flexible flat cable 1 will initially form a curve as shown in FIG. 3*b* or will be forced into a curve from a generally flat insertion as shown in FIG. 2, the exposed conductors 2 face the floor wall of the connector housing.

After insertion the flexible flat cable 1 in the connector housing, the actuator 17 is lowered to the locking condition 19 (solid lines in FIG. 6), thus completing the insertion position of the cable in the housing. In this position the cable 1 is pushed against the floor wall 12 of the connector housing, changing its shape from the letter "C" to the letter "U" in cross section. In this position the conductors 2 of the cable 1 are forced into contact with the terminals 8 of the connector 1. Finally, the actuator 17 and cable are moved toward the housing thereby locking the cable and actuator 17 in the housing.

As shown in FIG. 1 each side wall 13, 14 of the housing 6 has a tapered portion 20 extending at an angle from the ceiling wall 11 converging toward the floor wall 12 and a normal portion 21 extending at a right angle from the floor wall 12. The tapered and normal portions are joined together.

As the fastening means 10 or actuator 17 is lowered into the locking position, applying a force F to the cable 1, the cable is curved in the form of a circular arc. This permits the opposed longitudinal sides of the cable 1 to yieldingly bend so as to be automatically guided toward the lateral alignment position relative to the terminals 8 by the tapered portions 20 of the opposite side walls 13 and 14. The resilience of the bent cable creates the equilibrium condition. Finally, the cable 1 is pushed against the floor wall 12 of the connector housing 6 by the fastening means 10 or actuator 17 so that the cross section of the cable 1 is changed from "C"-shaped arc to a "U" shape, forcing the conductors 2 of the cable 1 into contact with the terminal contacts 9 of the connector housing 6, as seen from FIG. 3A.

As may be understood from the above, the trapezoidal cable insertion space with the reduced lateral dimension has the effect of facilitating insertion of a flexible flat cable equidistant from the side walls and of aligning the conductors of the cable in the connector housing relative to the terminals of the connector housing. FIGS. 1, 2 and 3 show the connector housing as defining an enclosed space by its ceiling wall, floor wall and opposed side walls. It, however, should be noted that a connector housing having no ceiling wall 11 or floor wall 12 may be used. For example, the connector housing may have no ceiling, and it may be composed of a floor wall and opposite diverging side walls, thus permitting a flexible flat cable to be put in the open enclosure from the top, pushing the cable against the floor wall, which has terminals fixed therein.

We claim:

1. An electrical connector for connecting a flexible flat cable having a given width to an electrical device, comprising:

a dielectric housing having an insertion space adapted to receive an end of the flexible flat cable through an insertion space opening;

the insertion space defined by a floor wall and an opposed ceiling wall and two opposed symmetrical side walls extending between the floor and ceiling walls;

electrical terminals secured in the floor wall, each terminal having a contact portion extending from the floor wall into the insertion space for electrical connection to a respective exposed conductor on the flexible flat cable when the end of the flexible flat cable is positioned in the insertion space;

the insertion space opening defined by edges of the floor and ceiling walls and the opposed symmetrical side walls, the opposed side walls forming a dimension therebetween parallel to the floor wall which increases as the side walls extend from the floor wall to the ceiling wall, the longest dimension between the side walls being less than or equal to the width of the flexible flat cable so that each longitudinal edge of the end of the cable contacts a respective side wall causing the end of the flexible flat cable to form a curve about the longitudinal axis of the cable with an apex of the curve being located closer to the floor wall rather than to the ceiling wall, whereby the end of cable is centered laterally between the opposed side walls causing the exposed conductors of the end of cable to be in alignment with the contact portions of the terminals; and an actuator mounted to the housing to move from an open position, enabling the end of the cable to be inserted into the insertion space, to a closed position, forcing the end of the cable toward the floor wall creating an aligned engagement between the exposed conductors of the cable and the contact portions of the terminals.

2. An electrical connector, according to claim 1 wherein the insertion space opening forms a trapezoid with generally flat tapered opposed side walls.

3. An electrical connector, according to claim 1, wherein the opposed side walls comprise an angled portion and a normal portion, the angled portion forming an oblique angle with the ceiling wall, the normal portion forming an angle generally perpendicular to the floor wall, and one end of each angled and normal portions being joined to one another.

4. An electrical connector, according to claim 3, wherein the actuator has a specific width dimension which is equal to or less than a distance between the normal portion of each of the opposed side walls.

5. An electric connector according to claim 1, wherein the actuator is pivotally mounted to the housing.

* * * * *